US009476658B1

(12) United States Patent
Rojas

(10) Patent No.: US 9,476,658 B1
(45) Date of Patent: Oct. 25, 2016

(54) AIR CONDITIONER CLEANING ASSEMBLY

(71) Applicant: Nelson Rojas, St. Croix, VI (US)

(72) Inventor: Nelson Rojas, St. Croix, VI (US)

( * ) Notice: Subject to any disclaimer, the term of this patent is extended or adjusted under 35 U.S.C. 154(b) by 849 days.

(21) Appl. No.: 13/762,498

(22) Filed: Feb. 8, 2013

(51) Int. Cl.
*F28G 1/16* (2006.01)
*F25D 21/14* (2006.01)
*F24F 13/22* (2006.01)

(52) U.S. Cl.
CPC ..... *F28G 1/166* (2013.01); *F24F 13/222* (2013.01)

(58) Field of Classification Search
CPC ..... F24F 13/22; F24F 13/222; F24F 13/227; B08B 9/00; B08B 9/023; B08B 3/02; F28G 1/166
See application file for complete search history.

(56) References Cited

U.S. PATENT DOCUMENTS 4,513,586 A 4/1985 Jennings et al.
4,941,901 A 7/1990 Ramakrishnan et al.
D346,741 S 5/1994 McIntyre
5,899,217 A * 5/1999 Testman, Jr. ..... B08B 17/00 134/104.2
7,392,658 B1 7/2008 Hardy, III
7,523,854 B2 4/2009 Gray
7,992,405 B2 8/2011 Cushen
2007/0264138 A1* 11/2007 Mandell ..... B05B 7/0093 417/382

FOREIGN PATENT DOCUMENTS

JP 3146261 U * 11/2008 ..... B08B 3/02

OTHER PUBLICATIONS

Machine English Translation of JP 3146261 U (Niikura H , Nov. 2008).*

* cited by examiner

*Primary Examiner* — Michael Barr
*Assistant Examiner* — Irina Graf

(57) ABSTRACT

An air conditioner cleaning assembly cleans a housing of an air conditioning unit. The assembly includes a drain tray having a pair of side walls and a base wall coupled to and extending between the side walls. The base wall and the side walls defining a trough configured for receiving a fluid. An aperture extends through the base wall of the drain tray wherein the aperture drains the fluid from the trough. An attachment strap is coupled to and extends from the drain tray for securing the drain tray to an air conditioner such that the drain tray is positioned under the air conditioner. A sprayer assembly includes a sprayer for delivering fluid into a housing of the air conditioner.

11 Claims, 5 Drawing Sheets

AIR CONDITIONER CLEANING ASSEMBLY

BACKGROUND OF THE DISCLOSURE

Field of the Disclosure

The disclosure relates to cleaning devices and more particularly pertains to a new cleaning device for cleaning a housing of an air conditioning unit.

SUMMARY OF THE DISCLOSURE

An embodiment of the disclosure meets the needs presented above by generally comprising a drain tray having a pair of side walls and a base wall coupled to and extending between the side walls. The base wall and the side walls defining a trough configured for receiving a fluid. An aperture extends through the base wall of the drain tray wherein the aperture drains the fluid from the trough. An attachment strap is coupled to and extends from the drain tray for securing the drain tray to an air conditioner such that the drain tray is positioned under the air conditioner. A sprayer assembly includes a sprayer for delivering fluid into a housing of the air conditioner.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
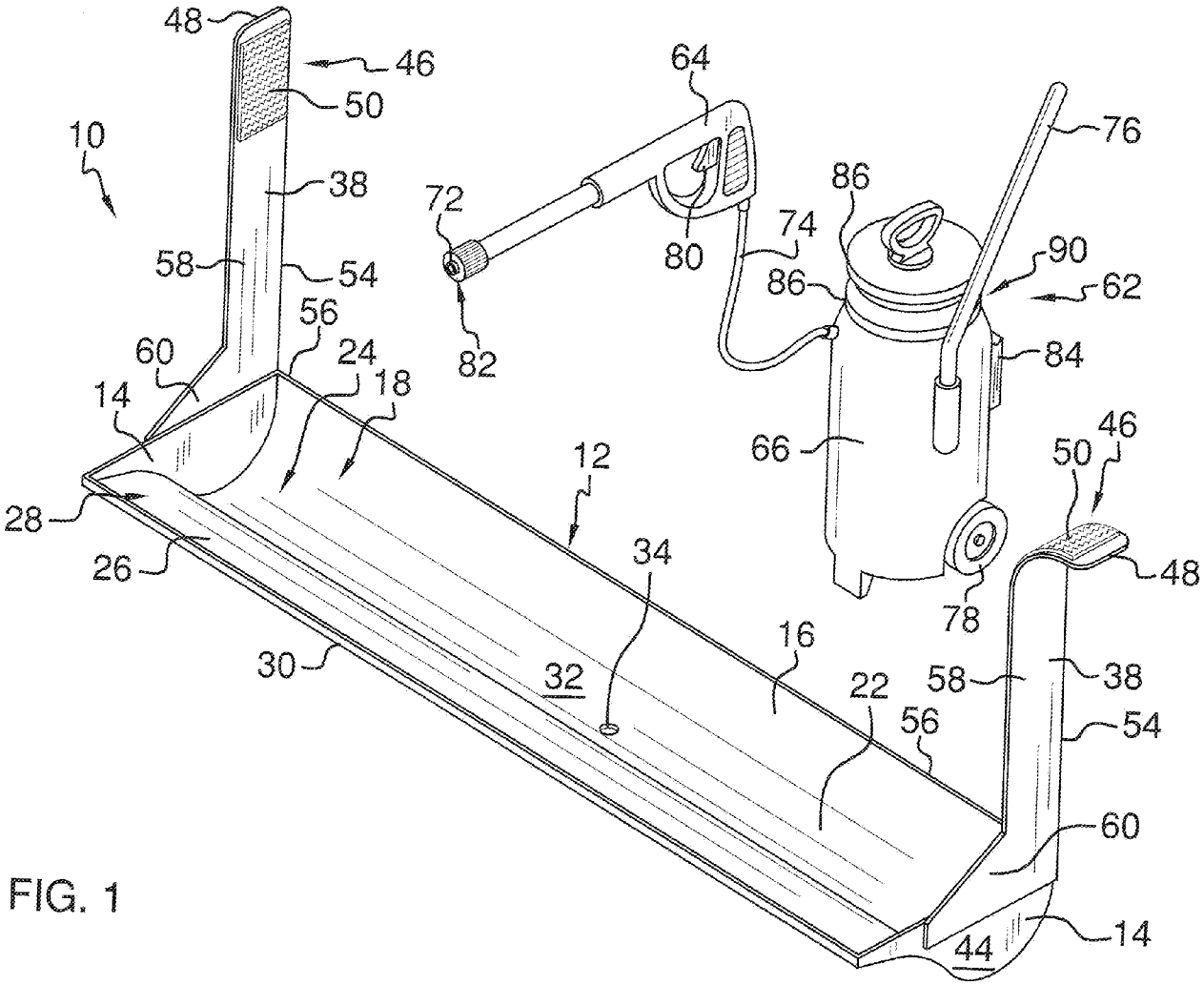
FIG. 1 is a top front side perspective view of an air conditioner cleaning assembly according to an embodiment of the disclosure.
Figure 2:
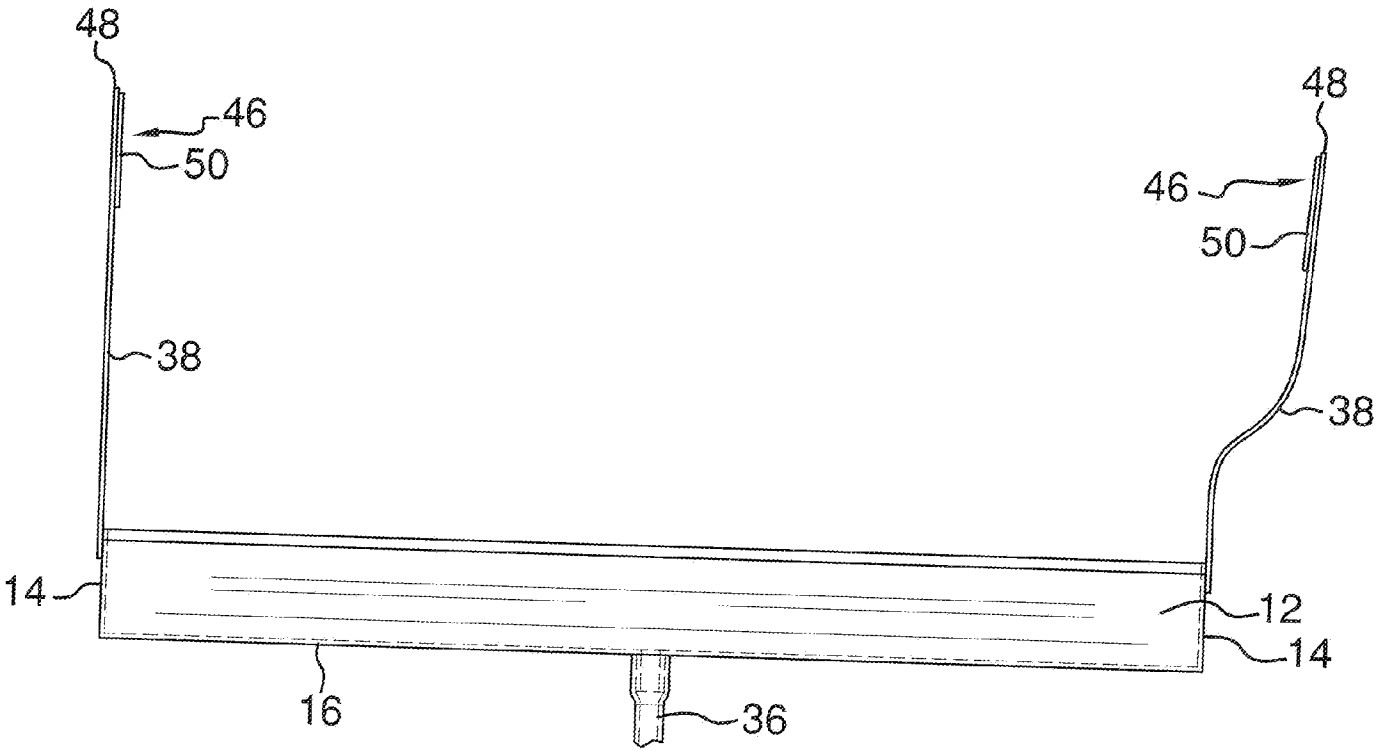
FIG. 2 is a top front side perspective view of an embodiment of the disclosure.
Figure 3:
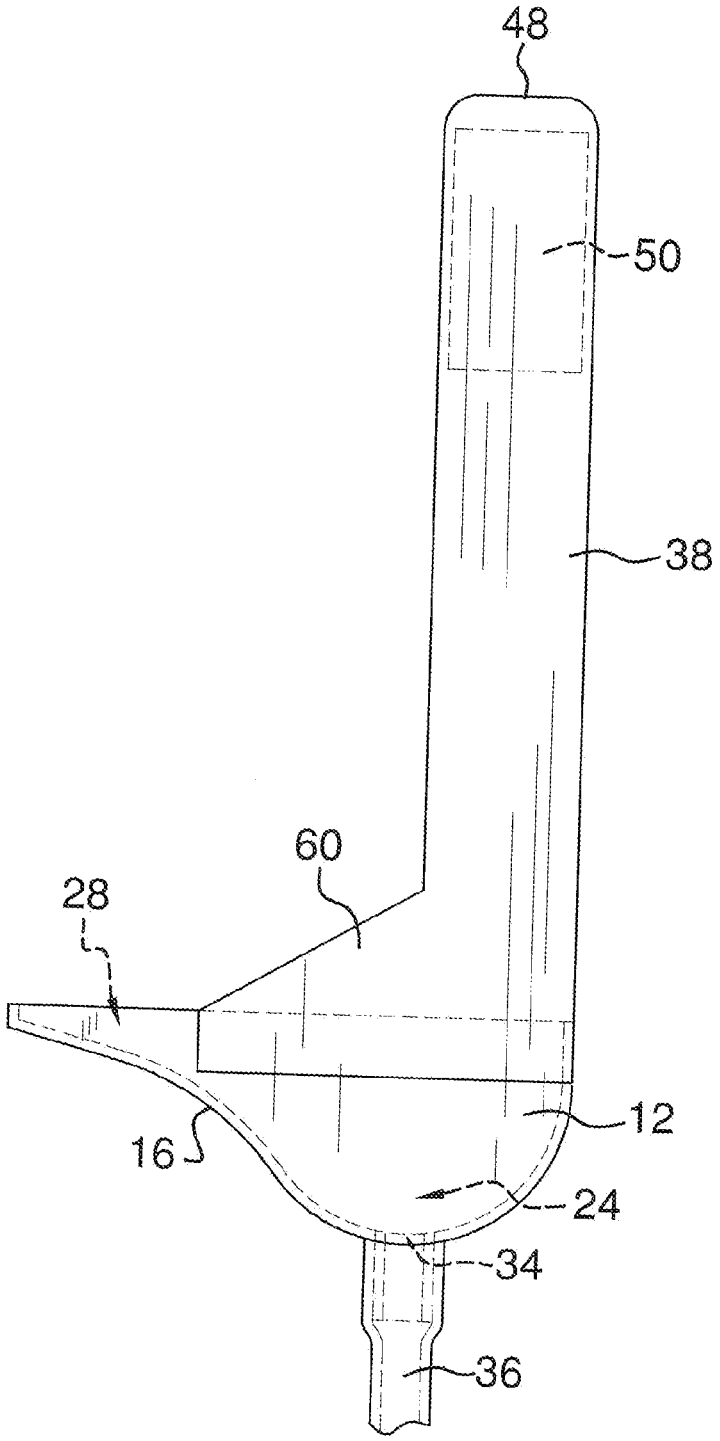
FIG. 3 is a front view of an embodiment of the disclosure.
Figure 4:
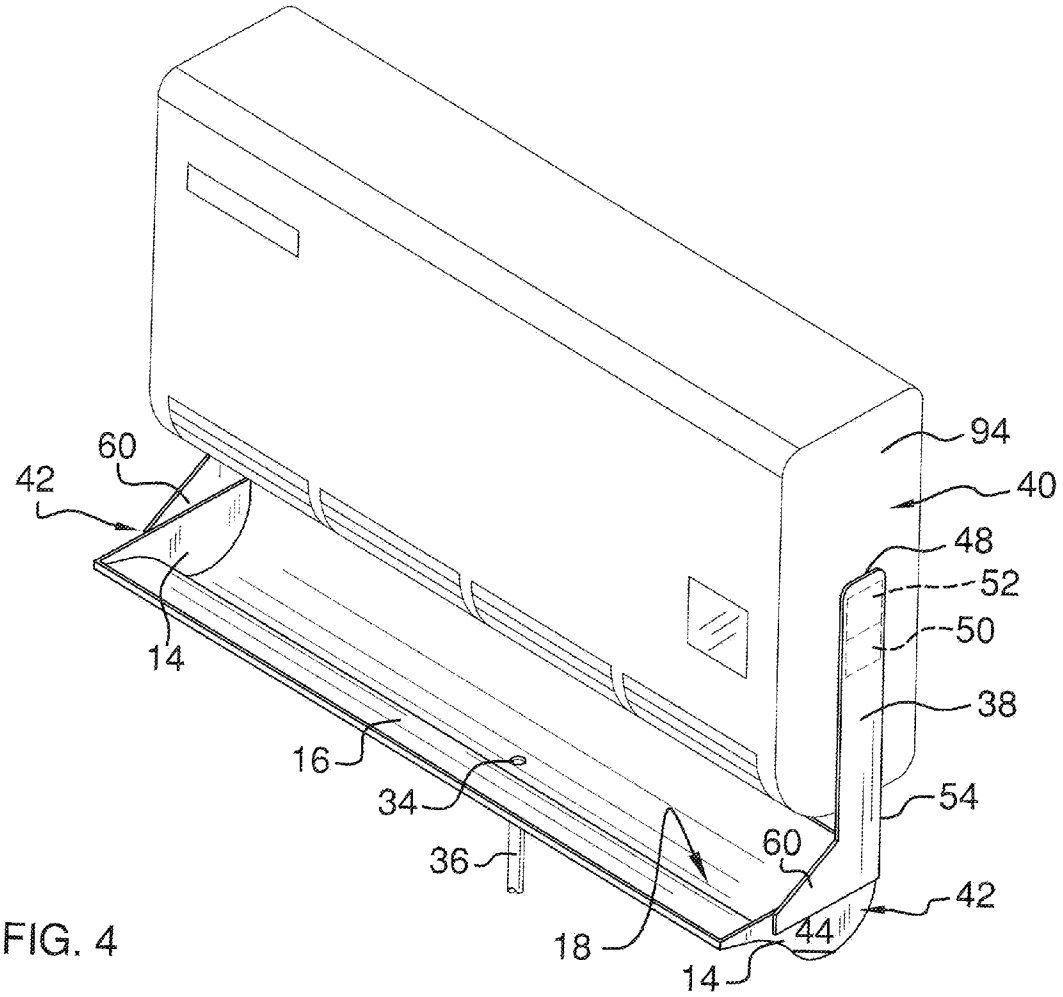
FIG. 4 is a side view of an embodiment of the disclosure.
Figure 5:
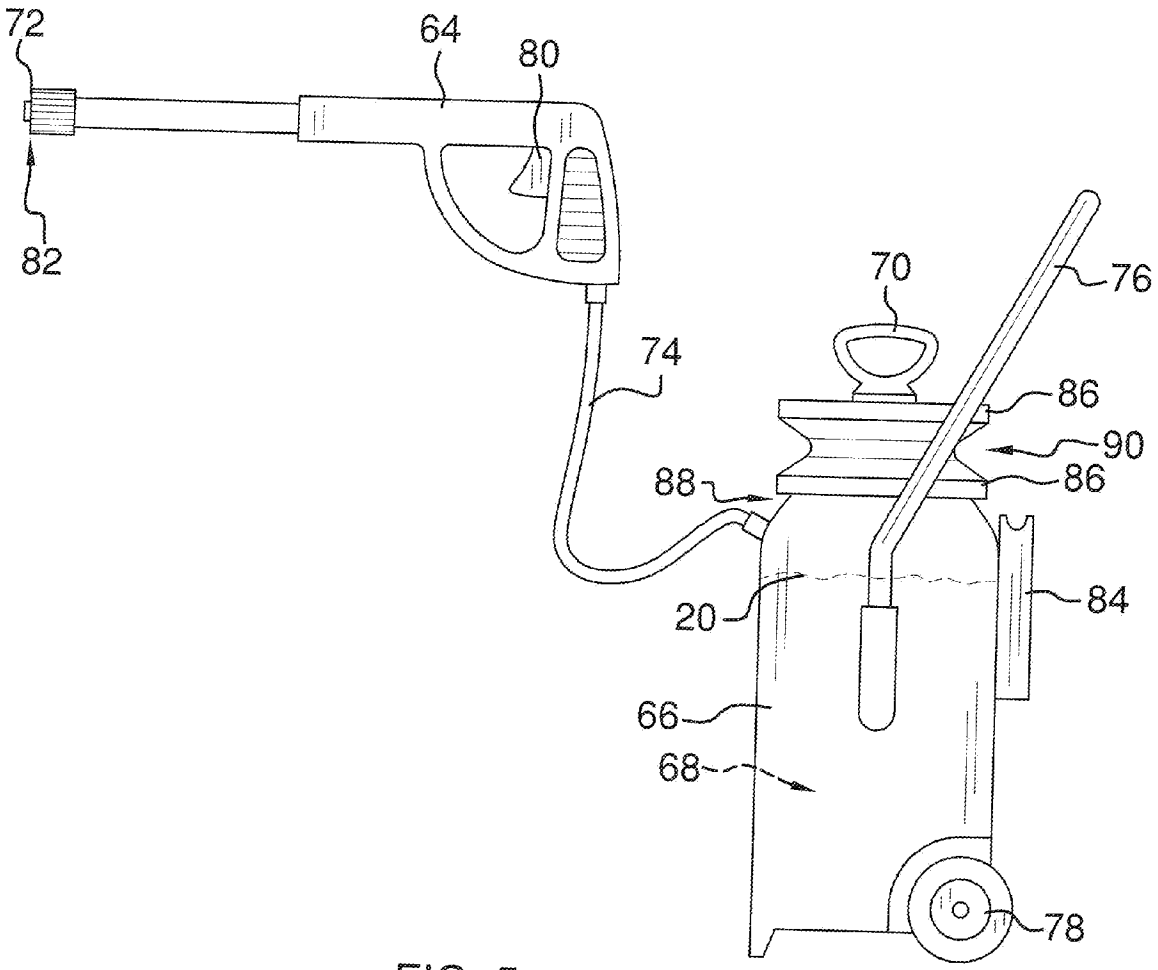
FIG. 5 is a side view of a sprayer assembly of an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the air conditioner cleaning assembly 10 generally comprises a drain tray 12 having a pair of side walls 14 and a base wall 16 coupled to and extending between the side walls 14. The base wall 16 and the side walls 14 define a trough 18 configured for receiving a fluid 20. The base wall 16 of the drain tray 12 has a base portion 22 forming a bottom portion 24 of the trough 18. The base wall 16 of the drain tray 12 also has a top portion 26 extending from the base portion 22 of the base wall 16 forming a sluice portion 28 of the trough 18. The top portion 26 of the base wall 16 is curved to extend rearward and downward from a forward edge 30 of the drain tray 12. The base portion 22 of the base wall 16 is curved wherein a bottom surface 32 of the trough 18 is curved along a longitudinal axis of the trough 18. Thus, fluid 20 is substantially directed by gravity to a lowest point in the trough 18. An aperture 34 extends through the base wall 16 of the drain tray 12. The aperture is substantially positioned at the lowest point of the trough 18 wherein the aperture 34 is configured for draining the fluid 20 from the trough 18. A drain hose 36 may be coupled to the drain tray 12 in fluid communication with the trough 18 through the aperture 34. The drain hose 36 may be used to direct drained fluid 20 to a desired site such as a waste container for reclamation or storage or to a drainage system for permanent disposal.

A pair of attachment straps 38 is coupled to and extends from the drain tray 12 such that each attachment strap 38 is configured for securing the drain tray 12 to an air conditioner 40 such that the drain tray 12 is positioned under the air conditioner 40. Each attachment strap 38 is coupled to an associated end 42 of the drain tray 12. The straps 38 may each be coupled directly to an outer surface 44 of the side walls 14. Each of a pair of fasteners 46 is coupled to a distal end 48 of an associated one of the attachment straps 38 relative to the drain tray 12. Each fastener 46 is a first portion of hook and loop fastener 50. Each of a pair of second portions of hook and loop fastener 52 is configured for coupling to the air conditioner 40. Each second portion of hook and loop fastener 52 is complementary to an associated one of the first portions of hook and loop fastener 50. Thus, each strap 38 couples the drain tray 12 to the air conditioner 40. A rear edge 54 of each attachment strap 38 is aligned with a rearward edge 56 of the drain tray 12. Each attachment strap 38 further has a main portion 58 and a gusset portion 60. The gusset portion 60 extends between the drain tray 12 and the main portion 58 to support the sluice portion 28 of the trough 18.

A sprayer assembly 62 has a sprayer 64 configured for delivering a flow of fluid 20 into a housing 94 of the air conditioner 40 to wash debris and dust from the air conditioner 40. The fluid 20 drains out of the housing 94 of the air conditioner 40 into the drain tray 12. A tank 66 has an interior space 68 configured for holding the fluid 20. A pump 70 is operationally coupled to the tank 66 for pressurizing the fluid 20 in the tank 66. A nozzle 72 is coupled to the tank 66 for selectively dispersing the fluid 20 from the tank 66. A flexible nozzle hose 74 couples the nozzle 72 to the tank 66 to permit free positioning of the nozzle 72 in a desired position without having to reposition the tank 66. A handle 76 is coupled to the tank 66. At least one wheel 78 is coupled to the tank 66 to facilitate positioning of the tank 66 in a desired location proximate the air conditioner 40.

A trigger 80 is coupled to the nozzle 72. The trigger 80 is operationally coupled to the nozzle 72 wherein the fluid 20 is selectively expelled from the nozzle 72 upon manipulation of the trigger 80. An adjustable head 82 of conventional design is operationally coupled to the nozzle 72 wherein a spray pattern of the fluid 20 being dispensed from the nozzle 72 is adjustable. A holster 84 is coupled to the tank 66. The nozzle 72 is selectively engageable to the holster 84 for storage. A pair of spaced flanges 86 extend from the tank 66 proximate a top 88 of the tank 66 defining a channel 90 extending around the tank 66. Thus, the flexible hose 74 is positionable in the channel 90 wrapping around the tank 66 wherein the flexible hose 74 is retained in the channel 90 when the nozzle 72 is engaged to the holster 84.

In use, the drain tray 12 is coupled to the air conditioner 40. The sprayer 64 is used to expel fluid 20 into the air conditioner 40 to wash dirt and debris from the housing 94. The fluid 20 drains from the housing 94 into the drain tray 12 for reclamation, temporary storage, or immediate disposal.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An air conditioner cleaning assembly comprising:

a drain tray having a pair of side walls and a base wall coupled to and extending between said side walls, said base wall and said side walls defining a trough configured for receiving a fluid, said base wall of said drain tray having a base portion forming a bottom portion of said trough, said base wall of said drain tray having a top portion extending from said base portion, said top portion forming a sluice portion of said trough, said top portion of said base wall inclining curvedly downwardly as the top portion extends rearwardly from a forward edge of said drain tray;

an aperture extending through said base wall of said drain tray wherein said aperture is configured for draining the fluid from said trough;

a pair of attachment straps, each said attachment strap being coupled to an associated end of said drain tray and extending from said drain tray, wherein said attachment straps are configured for securing said drain tray to an air conditioner such that said drain tray is positioned under the air conditioner, such that a rear edge of each said attachment strap is aligned with a rearward edge of said drain tray, a front edge of each said attachment strap is positioned directly above the base portion and the top portion extends forwardly beyond the front edge of each said attachment strap; and a sprayer assembly having a sprayer configured for delivering a flow of fluid into a housing of the air conditioner wherein the fluid drains out of the housing of the air conditioner into the drain tray.

2. The assembly of claim 1, further comprising a drain hose coupled to said drain tray, said drain hose being in fluid communication with said trough through said aperture.

3. The assembly of claim 1, further comprising a pair of fasteners, each fastener being coupled to a distal end of an associated one of said attachment straps relative to said drain tray.

4. The assembly of claim 3, further comprising:

each said fastener being a first portion of hook and loop fastener; and a pair of second portions of hook and loop fastener, each second portion of hook and loop fastener being configured for coupling to the air conditioner, each said second portion of hook and loop fastener being complementary to an associated one of said first portions of hook and loop fastener.

5. The assembly of claim 1, further comprising said base portion of said base wall being curved wherein a bottom surface of said trough is curved along a longitudinal axis of said trough.

6. The assembly of claim 1, further comprising each attachment strap having a main portion and a gusset portion, said gusset portion extending between said drain tray and said main portion.

7. The assembly of claim 1, wherein said sprayer assembly further comprises:

a tank having an interior space configured for holding the fluid;

a pump operationally coupled to said tank for pressurizing the fluid in said tank;

a nozzle fluidly coupled to said tank for selectively dispersing the fluid from said tank; and a flexible nozzle hose fluidly coupling said nozzle to said tank.

8. The assembly of claim 7, wherein said sprayer assembly further comprises:

a handle coupled to said tank; and at least one wheel coupled to said tank.

9. The assembly of claim 7, wherein said sprayer assembly further comprises:

a trigger coupled to said nozzle, said trigger being operationally coupled to said nozzle wherein the fluid is selectively expelled from said nozzle; and an adjustable head operationally coupled to said nozzle wherein a spray pattern of the fluid being dispensed from said nozzle is adjustable.

10. The assembly of claim 7, wherein said sprayer assembly further comprises:

a holster coupled to said tank, said nozzle being selectively engageable to said holster; and a pair of spaced flanges extending from said tank defining a channel extending around said tank, said flexible hose being positionable in said channel wrapping around said tank wherein said flexible hose is retained in said channel when said nozzle is engaged to said holster.

11. An air conditioner cleaning assembly comprising:

a drain tray having a pair of side walls and a base wall coupled to and extending between said side walls, said base wall and said side walls defining a trough configured for receiving a fluid, said base wall of said drain tray having a base portion forming a bottom portion of said trough, said base wall of said drain tray having a top portion extending from said base portion forming a sluice portion of said trough, said top portion of said base wall inclining curvedly downwardly as the top portion extends rearwardly from a forward edge of said drain tray, said base portion of said base wall being curved wherein a bottom surf ace of said trough is curved along a longitudinal axis of said trough;

an aperture extending through said base wall of said drain tray wherein said aperture is configured for draining the fluid from said trough;

a drain hose coupled to said drain tray, said drain hose being in fluid communication with said trough through said aperture;

a pair of attachment straps coupled to and extending from said drain tray wherein each said attachment strap is configured for securing said drain tray to an air conditioner such that said drain tray is positioned under the air conditioner, each said attachment strap being coupled to an associated end of said drain tray;

a pair of fasteners, each fastener being coupled to a distal end of an associated one of said attachment straps relative to said drain tray, each said fastener being a first portion of hook and loop fastener;

a pair of second portions of hook and loop fastener, each second portion of hook and loop fastener being configured for coupling to the air conditioner, each said second portion of hook and loop fastener being complementary to an associated one of said first portions of hook and loop fastener;

a rear edge of each said attachment strap being aligned with a rearward edge of said drain tray, and a front edge of each said attachment strap being positioned directly above the base portion and the top portion extending forwardly beyond the front edge of each said attachment strap, each attachment strap having a main portion and a gusset portion, said gusset portion extending between said drain tray and said main portion; and a sprayer assembly having a sprayer configured for delivering a flow of fluid into a housing of the air conditioner wherein the fluid drains out of the housing of the air conditioner into the drain tray, wherein said sprayer assembly further comprises a tank having an interior space configured for holding the fluid, a pump operationally coupled to said tank for pressurizing the fluid in said tank, a nozzle fluidly coupled to said tank for selectively dispersing the fluid from said tank, a flexible nozzle hose fluidly coupling said nozzle to said tank, a handle coupled to said tank, at least one wheel coupled to said tank, a trigger coupled to said nozzle, said trigger being operationally coupled to said nozzle wherein the fluid is selectively expelled from said nozzle, an adjustable head operationally coupled to said nozzle wherein a spray pattern of the fluid being dispensed from said nozzle is adjustable, a holster coupled to said tank, said nozzle being selectively engageable to said holster, and a pair of spaced flanges extending from said tank defining a channel extending around said tank wherein said flexible hose is positionable in said channel wrapping around said tank wherein said flexible hose is retained in said channel when said nozzle is engaged to said holster.

* * * * *